US006772689B2

(12) United States Patent
Endo et al.

(10) Patent No.: US 6,772,689 B2
(45) Date of Patent: Aug. 10, 2004

(54) PRINTING QUALITY INSPECTION APPARATUS

(75) Inventors: Yutaka Endo, Chiba (JP); Kenji Kasama, Chiba (JP); Norihiro Kumagai, Chiba (JP); Kenji Hayashi, Chiba (JP); Mitsuhiro Uehara, Chiba (JP)

(73) Assignee: Komori Corporation, Tokyo (JP)

( * ) Notice: Subject to any disclaimer, the term of this patent is extended or adjusted under 35 U.S.C. 154(b) by 116 days.

(21) Appl. No.: 09/956,961

(22) Filed: Sep. 21, 2001

(65) Prior Publication Data

US 2002/0035939 A1 Mar. 28, 2002

(30) Foreign Application Priority Data

Sep. 22, 2000 (JP) ..... 2000-288795

(51) Int. Cl.[7] ..... B41C 41/60; B65H 3/44; B41J 29/393

(52) U.S. Cl. ..... 101/483; 101/232; 101/485; 101/486; 101/409; 271/9.01; 271/204; 271/205; 347/19; 347/101; 347/105; 347/106

(58) Field of Search ..... 101/483, 485, 101/486, 409, 232; 347/19, 101, 105, 106; 271/901, 204, 205, 9.07

(56) References Cited

U.S. PATENT DOCUMENTS 5,329,852 A 7/1994 Bolza-Schuenemann et al.
5,459,941 A * 10/1995 Lowe ..... 33/620
5,740,729 A * 4/1998 Hikita et al. ..... 101/126
5,835,108 A * 11/1998 Beauchamp et al. ..... 347/19
5,875,028 A * 2/1999 Lasken et al. ..... 356/244
5,974,683 A * 11/1999 Shibata ..... 34/88
6,106,094 A * 8/2000 Otani et al. ..... 347/19

FOREIGN PATENT DOCUMENTS

JP 4-220345 A 8/1992
JP 5-254091 A 10/1993
JP 06-238867 * 8/1994
WO WO 94/08791 4/1994

* cited by examiner

*Primary Examiner*—Andrew H. Hirshfeld
*Assistant Examiner*—Marvin P Crenshaw
(74) *Attorney, Agent, or Firm*—Birch, Stewart, Kolasch & Birch, LLP

(57) ABSTRACT

An inspection unit of an intaglio printing press includes a suction table for correcting the position of printed sheet-like object as being disposed inside of a unit frame, and a camera and a light for inspecting the printing quality of sheet-like object being corrected of position by the suction table provided in a shroud inside of the unit frame. The table is disposed in a moving table with casters so as to move the suction table between a working position inside of the frame and a maintenance position outside thereof. The shroud is supported on first support rails through support rollers so that the camera and light can be moved between the working position inside of the frame and the maintenance position outside thereof, while support rails and their stand are disposed so as to be accommodated outside the frame.

12 Claims, 5 Drawing Sheets

PRINTING QUALITY INSPECTION APPARATUS

The entire disclosure of Japanese Patent Application No. 2000-288795 filed on Sep. 22, 2000 including specification, claims, drawings, and summary is incorporated herein by reference in its entirety.

BACKGROUND OF THE INVENTION

1. Field of the Invention

The present invention relates to a printing quality inspection apparatus of printed sheet-like object, particularly effective when applied in inspection of printing quality of printed sheet-like object.

2. Related Art

Between a printing unit and a delivery unit of a printing press, an inspection device is installed for inspecting the printing quality of printed sheet-like object. This inspection device is designed to suck a printed sheet, in the midst of transfer of the sheet to a delivery table by means of a delivery chain after being printed in the printing unit, onto a suction table, spread the sheet uniformly, an image of the printed surface of the printed sheet by a CCD camera or other image taking device, compare signal from the camera and the predetermined quality standard by means of a control device, and discharge the sheet onto the delivery table while sorting between sheet-like object satisfying the quality standard and sheet-like object not satisfying the quality standard (for example, Japanese Laid-open Patent No. 5-254091).

SUMMARY OF THE INVENTION

As the printing quality is inspected in this manner, paper dust of sheet-like object and mist of printing ink are collected on the suction holes of the suction table and/or the lens of the camera, and, gradually, it becomes difficult to continue inspection. Therefore, cleaning of the suction table and camera is required every specific operating time. However, since the suction table and camera are assembled inside the main body frame, the working position is difficult for maintenance, and the working efficiency is lowered.

It is hence an object of the present invention to present a printing quality inspection apparatus featuring ease of maintenance.

To solve the above problems, the printing quality inspection apparatus according to th first aspect of the invention is directed to a printing quality inspection apparatus having inspection means for inspecting the printing quality of a printed sheet-like object, in which inspection moving means is provided to move the inspection means between a working position for inspecting the printing quality of the printed sheet-like object and a maintenance position for maintaining the inspection means.

The printing quality inspection apparatus according to the second aspect of the invention is directed to correcting means for correcting the position of the printed sheet-like object and inspection means disposed inside of a frame for inspecting the printing quality of sheet-like object corrected of position by the correcting means in which moving means is provided to move at least either one of the correcting means and the inspection means to a maintenance position for maintaining.

The printing quality inspection apparatus according to the third aspect of the invention relates to the printing quality inspection apparatus of the second aspect, wherein inspection moving means is provided to move the inspection means between the working position inside the frame and the maintenance position outside the frame.

The printing quality inspection apparatus according to the fourth aspect of the invention relates to the printing quality inspection apparatus of the third aspect, wherein inspection moving means is provided to move the inspection means between the working position inside the frame and the maintenance position outside the frame.

The printing quality inspection apparatus according to the fifth aspect of the invention relates to the printing quality inspection apparatus of the third aspect, wherein the support rail comprises a first support rail provided inside the frame for supporting the support roller, and a second support rail pivotally disposed swing outside the frame so as to be positioned on the extension the first support rail.

The printing quality inspection apparatus according to the sixth aspect of the invention relates to the printing quality inspection apparatus of the fifth aspect, wherein the support roller is rotatably disposed at an inspection means side, and the guide is a support rail for supporting the support roller, and connecting between the working position and the maintenance position of the inspection means.

The printing quality inspection apparatus according to the seventh aspect of the invention relates to the printing quality inspection apparatus of the sixth aspect, where in the support rail comprises a first support rail provided inside the frame for supporting the support roller, and a second support rail movably provided so as to be positioned on the extension of the first support rail.

The printing quality inspection apparatus according to the eighth aspect of the invention relates to the printing quality inspection apparatus of the seventh aspect, wherein the second support rail is pivotally provided to swing so as to move between a guide position positioned on the extension of the first rail and a retreat position for retreating from the guide position.

The printing quality inspection apparatus according to the ninth aspect of the invention relates to the printing quality inspection apparatus of the sixth aspect, further comprising a restricting rail for restricting movement of the support roller in a direction orthogonal to the running direction of the support roller.

The printing quality inspection apparatus according to the tenth aspect of the invention relates to the printing quality inspection apparatus of the sixth aspect, further comprising, inspection positioning fixing means for positioning and fixing the inspection means so that the inspection means may be positioned at the working position.

The printing quality inspection apparatus according to the eleventh aspect of the invention relates to the printing quality inspection apparatus of the second aspect, wherein the moving means is corrector moving means for moving the correcting means between the working position for correcting the position of printed sheet-like object and the maintenance position.

The printing quality inspection apparatus, according to the twelfth aspect of the invention relates to the printing quality inspection apparatus of the eleventh aspect, wherein the corrector moving means comprises a roller provided at the correcting means side, and a guide provided inside the frame for guiding the moving of the correcting means.

The printing quality inspection apparatus according to the thirteenth aspect of the invention relates to the printing quality inspection apparatus of the twelfth aspect, further comprising, a support roller provided at either one of the frame side and the correcting means side and rotatable along the moving direction of the correcting means and a support rail provided at the other of the frame side and the correcting means side, being engaged with the support roller for restricting the movement of the correcting means in a direction orthogonal to the moving direction of the correcting means.

The printing quality inspection apparatus according to the fourteenth aspect of the invention relates to the printing quality inspection apparatus of the thirteenth aspect, further comprising, corrector positioning fixing means for positioning and fixing the correcting means so that the correcting means may be positioned at the working position.

The printing quality inspection apparatus according to the fifteenth aspect of the invention relates to the printing quality inspection apparatus of the second aspect, wherein the maintenance position includes an inspection means maintenance position for maintaining the inspection means and a correcting means maintenance position for maintaining the correcting means, and the moving means comprises corrector moving means for moving the correcting means between the correcting position for correcting the position of the printed sheet-like object and the correcting means maintenance position, and inspection moving means for moving the inspection means between the inspecting position for inspecting the printing quality of the printed sheet-like object and the inspection means maintenance position.

The printing quality inspection apparatus according to the sixteenth aspect of the invention relates to the printing quality inspection apparatus of the fifteenth aspect, wherein the moving direction of the inspection means by the inspection moving means and the moving direction of the correcting means by the corrector moving means are different.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
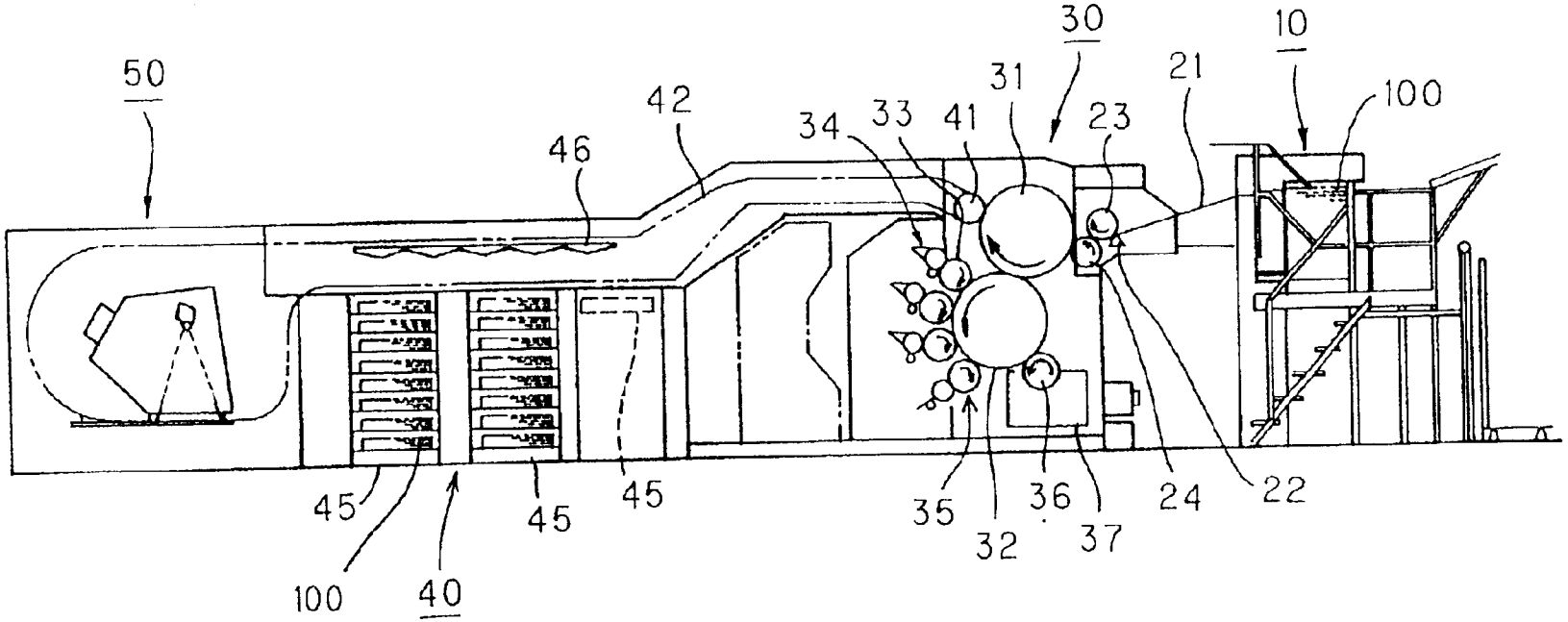
FIG. 1 is a general structural diagram of a printing quality inspection machine assembled in an intaglio printing press according to an embodiment of the invention.
Figure 2:
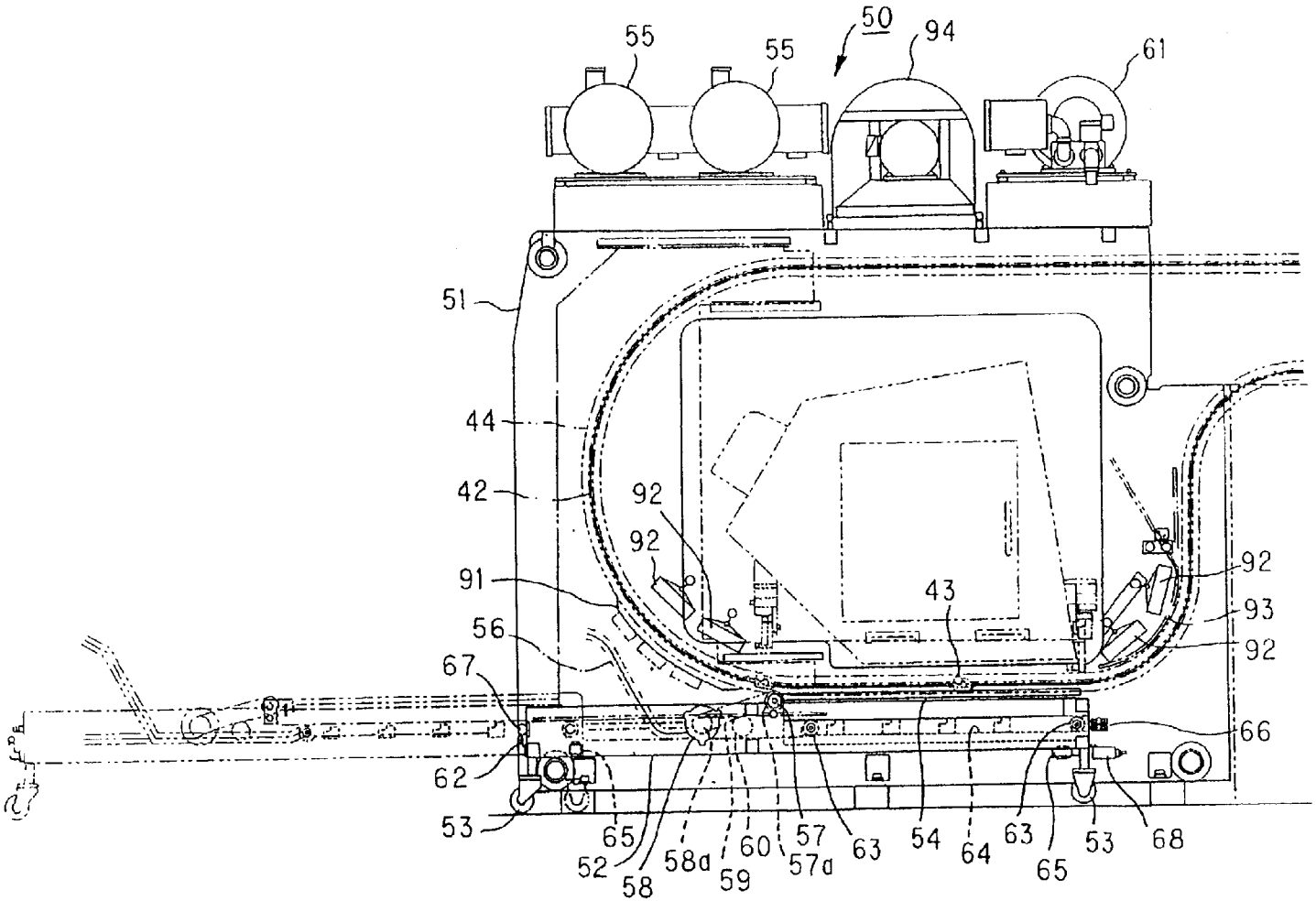
FIG. 2 is a schematic structural diagram of suction table section of inspection unit in FIG. 1.
Figure 3:
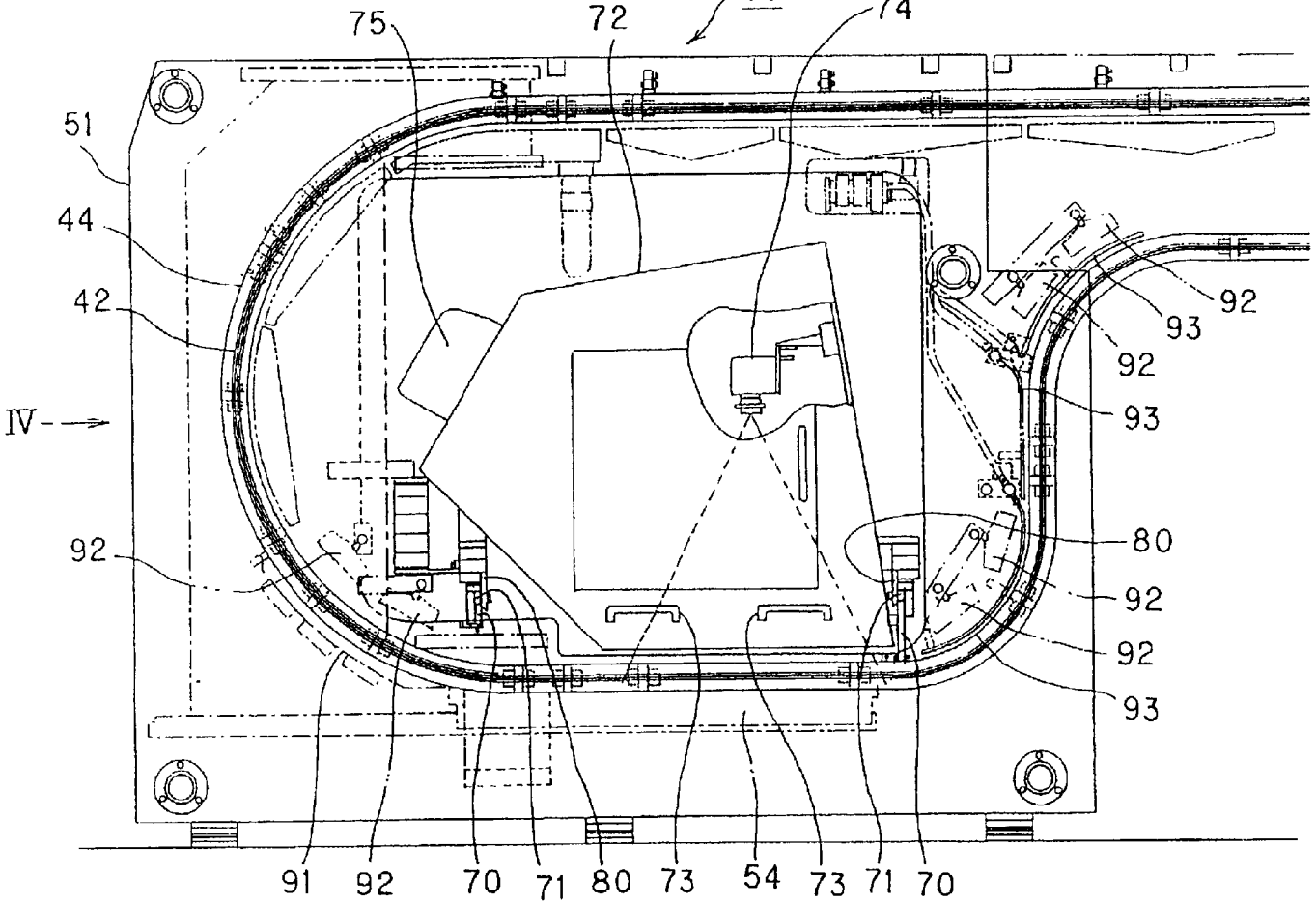
FIG. 3 is a schematic structural diagram of imaging section of the inspection unit in FIG. 2.
Figure 4:
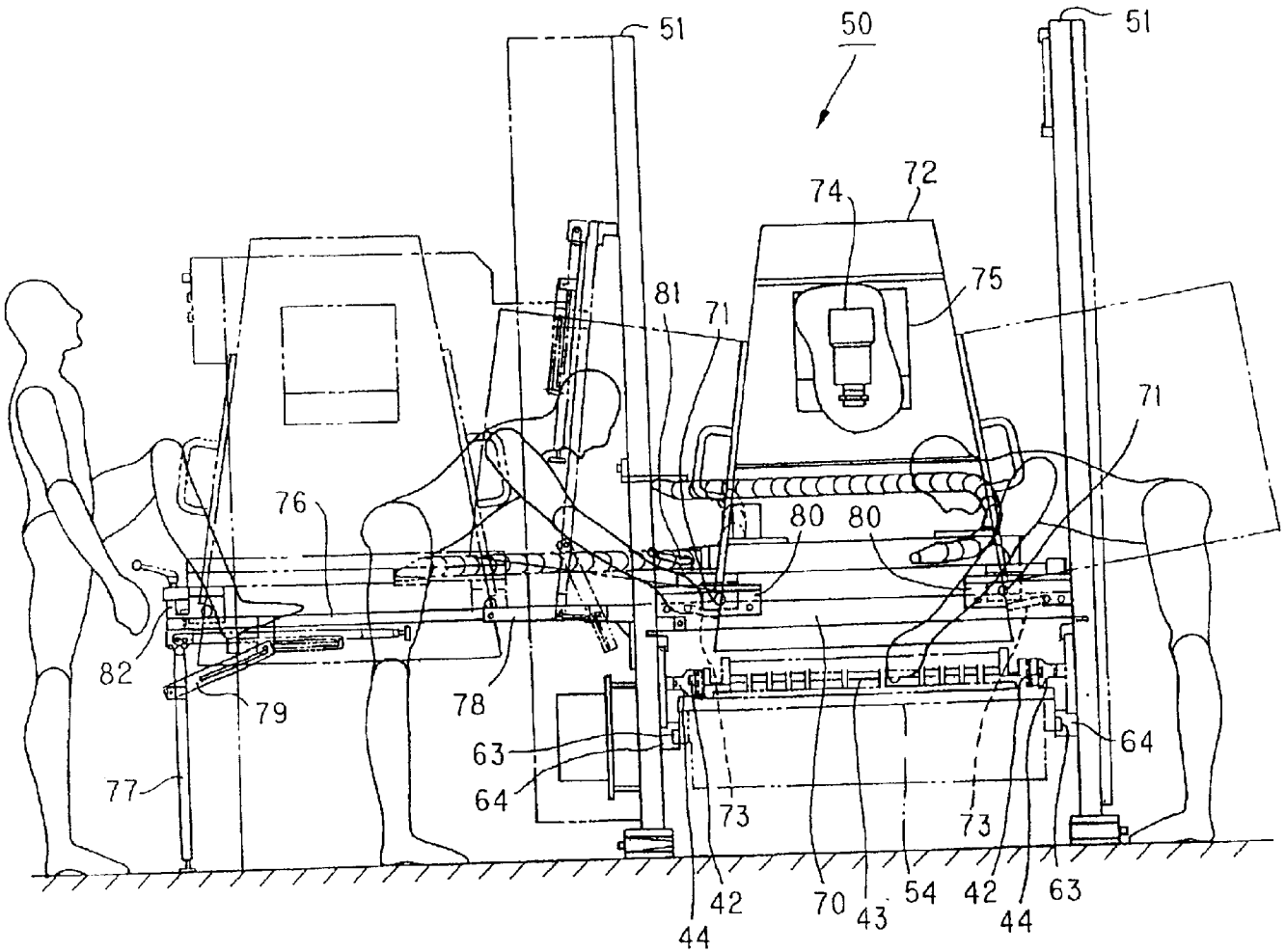
FIG. 4 is a view from arrow IV direction in FIG. 3.
Figure 5:
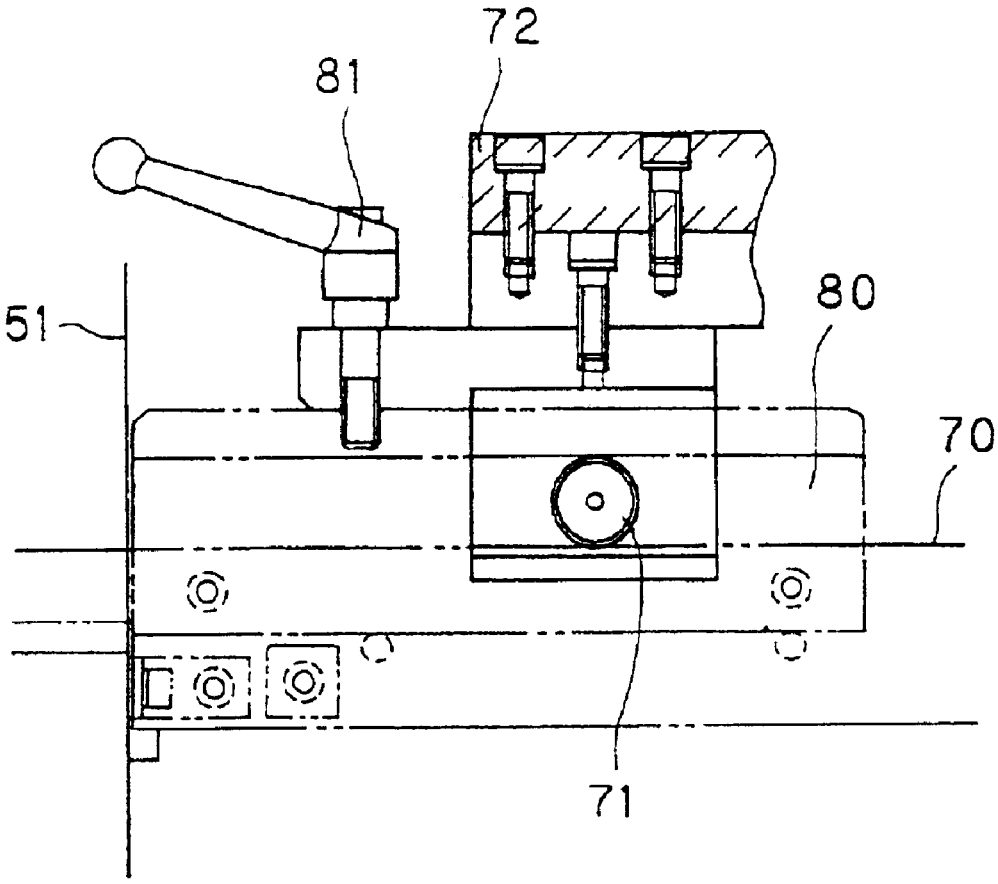
FIG. 5 is a magnified view of a fixing tool in FIG. 4.

A preferred embodiment of a printing quality inspection apparatus of the invention assembled in an intaglio printing press is explained by referring to FIG. 1 to FIG. 5. FIG. 1 is a general structural diagram of an intaglio printing press, FIG. 2 is a schematic structural diagram of suction table section of inspection unit, FIG. 3 is a schematic structural diagram of imaging section of the inspection unit in FIG. 2, FIG. 4 is a view from arrow IV direction in FIG. 3, and FIG. 5 is a magnified view of a fixing tool in FIG. 4.

As shown in FIG. 1, the base end side of a feeder board 21 is coupled to a sheet feeder 10 for feeding each sheet from a stack of sheet-like object 100. At the leading end side of the feeder board 21, there is a swing device 22 for transferring a sheet 100 to a gripper, not shown, provided in a transfer cylinder 23. This transfer cylinder 23 opposes a transfer cylinder 24 having a gripper not shown, and this transfer cylinder 23 transfers the sheet 100 held in the gripper to the gripper of the transfer cylinder 24.

The transfer cylinder 24 opposes an impression cylinder 31 of triple cylinder of a printing unit 30, and the sheet 100 held by the gripper is transferred to a gripper, not shown, of the impression cylinder 31. At the downstream side with respect to a rotating direction from the transfer cylinder 24 of the impression cylinder 31, an intaglio cylinder 32 of triple cylinder is in contact with the cylinder 31. At the downstream side with respect to the rotating direction from the impression cylinder 31 of the intaglio cylinder 32, a plurality of Chablon rollers 33, which are ink feed cylinders, are disposed at specific intervals along the peripheral direction of the intaglio cylinder 32 and in contact with the cylinder 32. Ink feeders 34 are in contact with these Chablon rollers 33.

At the downstream side with respect to the rotating direction from the Chablon rollers 33 of the intaglio cylinder 32, a pre-wiping device 35 is in contact with the cylinder 32. At the downstream side with respect to a rotating direction from the pre-wiping device 35 of the intaglio cylinder 32, a wiping roller 36 is in contact with the cylinder 32. The lower side of the wiping roller 36 is immersed in a wiping tank 37 filled with a wiping solution.

At the downstream side with respect to the rotating direction from the intaglio cylinder 32 of the impression cylinder 31, a delivery cylinder 41 is in contact with the cylinder 31. A chain 42 provided with a plurality of grippers 43 (refer to FIG. 2) at specific intervals for receiving the sheet-like object 100 from the gripper of the impression cylinder 31 is wound around the delivery cylinder 41. This chain 42 runs and moves along a chain guide 44 as shown in FIG. 2 and FIG. 3, and this chain guide 44 guides running of the chain 42 such that the sheet 100 received in the gripper 43 from the impression cylinder 31 passes near an air duct 46, passes through an inspection unit 50 which is the printing quality inspection apparatus of the invention, and then moves onto a delivery table 45 of a delivery unit 40.

As shown in FIG. 2, beneath the inside of a unit frame 51 of the inspection unit 50, there is a moving table 52 provided with casters 53 which are rolls that rolls along the running direction of the chain 52 in the lower part. In the upper part of the moving table 42, there is a suction table 54 as a box-shaped correcting means provided with multiple pores on the top, and this suction table 54 is coupled to a suction pump 55 disposed on the top of the unit frame 51 by means of a hose 56.

Near the upstream side end in running direction of the chain 42 of the suction table 54 on the moving table 52, a tubular suction roller 57, having multiple pores on the outer circumference thereof is rotatably provided. A pulley 57*a* is rotatably provided coaxially on the suction roller 57 integrally, and an endless belt 59, applied on a pulley 58*a* of a drive motor 58 provided on the moving table 52, is applied thereon. The suction roller 57 is coupled to a suction pump 61 disposed on the top of the unit frame 51 by means of a hose not shown. In FIG. 2, reference numeral 60 is a tension roller for adjusting the tension of the endless belt 59.

A handle 62 is attached to the moving table 52, and by gripping the handle 62 and moving the moving table 52 along the running direction of the chain 42, the moving table 52 can be moved between a working position (solid line position in FIG. 2) inside the unit frame 51, and a maintenance position (double dot chain line position in FIG. 2) outside the unit frame 51.

At both sides in the horizontal direction orthogonal to the moving direction of the moving table 52, a plurality of support rollers 63 rotatable along the moving direction of the suction table 54 are disposed at specific intervals. At both walls in the horizontal direction orthogonal to the moving direction of the moving table 52 of the working position of the moving table 52 in the unit frame 51, concave support rails 64 are provided for restricting the suction table 54 in the direction orthogonal to the moving direction of the suction table 54, as being engaged with the support rollers 63.

The support rails 64 are, in order to support the moving table 52 through the support rollers 63 when the moving table 52 comes to the working position, defined in configuration such that the length between the floor and the lower surface of support rail 64 at the maintenance position side of the moving table 52 may be nearly the same as the length between the lower side of the outer circumference of the support rollers 63 and the lower side of the outer circumference of the casters 53, and that the length between the floor and the lower surface of the support rail 64 at the working position portion for supporting the support rollers 63 may be slightly larger than the length between the lower side of the outer circumference of the support rollers 63 and the lower side of the outer circumference of the casters 53.

At both walls in the horizontal direction orthogonal to the moving direction of the moving table 52 in the unit frame 51, there are guide rollers 65, which are a plurality of guide members for guiding the moye of the moving table 52 while contacting with the sides of the moving table 52. The unit frame 51 further incorporates a stopper 66 for positioning and stopping the move of the moving table 52 so as to position the suction table 54 at the working position, and a lock device 67 for positioning and fixing the moving table 52 so as to position and fix the suction table 54 at the working position. In FIG. 2. reference numeral 68 is a limit switch.

In this embodiment, corrector moving means is composed of the casters 53, guide rollers 65, and others, while the corrector positioning fixing means is composed of the stopper 66, lock device 67, and others.

On the other hand, as shown in FIG. 3 and FIG. 4, above the working position of the suction table 54 in the unit frame 51, a pair of first support rails 70, having the longitudinal direction extended in the horizontal direction orthogonal to the running direction of the chain 42, are provided to bridge over the unit frame 51. Above the first support rails 70, a shroud 72, opened downward, is supported through support roller 71. At both end sides in the longitudinal direction of the first support rails 70 of the shroud 72, handles 73 are attached, and by gripping the handles 73, the shroud 72 can be moved along the first support rails 70. Above the inside of the shroud 72, a camera 74, such as CCD camera, and a light 75 are provided. In the embodiment, the inspection means is composed of the camera 74, light 75, and others.

As shown in FIG. 4, in the portion of the position on an extension of the first support rail 70 at one side of the unit frame 51, the base end sides of a pair of second support rails 76 are coupled so as to be rotatable about the axis with the axial direction in the horizontal direction orthogonal to the longitudinal direction of the first support rails 70. At the leading end sides of the second support rails 76, the base end of a bar-shaped stand 77 is coupled so as to be rotatable in the same direction as the rotating direction of the base end sides of the second support rails 76. At the base end sides of the second support rails 76, stopper plates 78 are provided for fixing and holding the second support rails 76 in a state of positioning the leading end sides of the second support rails 76 upward. At the leading end sides of the second support rails 76, stopper plates 79 are provided for fixing and holding the stand 77 in an upright position on the second support rails 76.

In this embodiment, thus, the support rails, which are guides, are composed of the first support rails 70, second support rails 76, and others, while the inspection moving means is composed of the support rails, support rollers 71, stand 77, stopper plates 78, 79, and others.

At both end sides in the longitudinal direction of the first support rails 70, restricting rails 80 are provided for restricting the movement of the support rollers 71 in a direction orthogonal to the running direction of the support rollers 71 without confining the rotation of the support rollers 71. As shown in FIG. 4 and FIG. 5, at the second support rail 76 side of the shroud 72, a fixing tool 81 is provided as inspection means positioning and fixing means for positioning and fixing the shroud 72 on the restricting rails 80, so that the camera 74 and light 75 may be positioned on the working position inside the unit frame 51. At the leading end sides of the second support rails 76, a fixing block 82 is provided for coupling the fixing tool 81 for fixing the shroud 72 so that the camera 74 and light 75 may be positioned at the maintenance position on the second support rails 76 outside of the unit frame 51.

In FIG. 2 and FIG. 3, reference numeral 91 is a suction device, 92 is a blowing fan, 93 is a draft tube, and 94 is a blowing pump.

In the intaglio printing press having such configuration, when a sheet 100 is supplied on the feeder board 21 from the paper feeder 10, the sheet 100 is transferred to the transfer cylinder 23 by means of a swing device 22, and is further transferred to the impression cylinder 31 through the transfer cylinder 24. On the other hand, when the ink is supplied to the intaglio cylinder 32 through Chablon cylinders 33*a* to 33*c* from the ink feeders 34*a* to 34*c*, the ink is deprived of extra portion by the pre-wiping device 35 and wiping roller 36, and is transferred to the sheet 100 held on the impression cylinder 31. The printed sheet 100 is transferred from the impression cylinder 31 to the delivery cylinder 41, and is gripped by the gripper 43, and is delivered into the inspection unit 50 as the chain 42 is driven along the chain guide 44.

The position of the sheet 100 running and moving in the inspection unit 50 is adjusted by the suction device 91 and blowing fan 92, and after the moving speed is decelerated by the suction roller 57, it is sucked by the suction table 54 to be corrected of its position, and runs and moves on the table 54. At this time, the camera 74 takes the image of the printing surface of the sheet 100, and a control device, not shown, compares the signal from the camera 74, and a predetermined quality standard, and judges the printing quality of the sheet 100. Thus, after inspection of printing quality, the sheet 100 leaves the suction table 54, and further runs and moves, and is discharged onto the delivery table 45 for approved sheet-like object if judged to satisfy the quality standard, or discharged onto the delivery table 45 for rejected sheet-like object if judged not to satisfy the quality standard.

After operating the printing press for a specific time, aside from the maintenance of the printing unit 30 and others, the inspection unit 50 is cleaned and checked as follows.

First, for maintaining the suction table 54, the lock device 67, attached to the unit frame 51, is unlocked, and the handle 62 is pulled. Then, the moving table 52 is moved from the working position inside of the unit frame 51 to the outside of the unit frame 51 as being guided by the guide roller 65 and others, the support roller 63 departs from the support rail 64, and the suction table 54 and suction roller 57 are drawn out to the maintenance position outside of the unit frame 51.

As a result, the suction table 54 and others are moved to a position free from obstacles, so that the maintenance of the suction table 54 and others can be done in a natural position.

After finishing the maintenance of the suction table 54 and others, and when the handle 62 is pushed, the moving table 52 is guided by the guide roller 65 and others and is moved from the maintenance position outside the unit frame 51 to the inside the unit frame 51. The support roller 63 is mounted on the support rail 64, the moving table 52 is pushed in until abutting against the stopper 66, and then by locking the moving table 52 by the lock device 67, the suction table 54 and others are positioned and fixed at the working position inside of the unit frame 51.

At this time, as explained above, since the length between the floor and the lower surface of the support rail 64 for supporting the support roller 63 is set slightly larger than the length between the lower side of the outer circumference of the support roller 63 and the lower side of the outer circumference of the caster 53, the moving table 52 is supported on the unit frame 51 through the support roller 63 and support rail 64.

Accordingly, the suction table 54 is positioned and fixed securely at the specified working position, so that the printing quality of the sheet 100 can be inspected precisely by the camera 74.

Next, in the case of maintenance of the camera 74 and light 75, the stopper plate 78 of the second support rail 76 is canceled, the second support rail 76 is tilted, the stand 77 is set upright, to hold the stopper plate 79 in upright position, and then the second support rail 76 is extended to the maintenance position outside of the unit frame 51. Thereoften, the fixing tool 81 of the shroud 72 is cleared, the handle 73 is pulled, the shroud 72 is moved along the firsts support rail 70 through the support roller 71 to be mounted on the second support rail 76, and is moved to the leading end side of the second support rail 76. By fixing the fixing tool 81 on the fixing block 82, the shroud 72 can be pulled out from the working position inside the unit frame 51 to the maintenance position outside the unit frame 51, and is fixed and held.

As a result, being moved to a position free from obstacles around the shroud 72, the maintenance of the camera 74 and light 75 in the shroud 72 can be done in a natural and comfortable position.

After the maintenance of the camera 74 and light 75, the fixing tool 81 is detached from the fixing block 82, and the handle 73 is pushed. Then, the shroud 72 is moved along the second support rail 76 through the support roller 71, is mounted on the first support rail 70, and returned to the working position inside of the unit frame 51. Thereafter the fixing tool 81 is fixed on the restricting rail 80, the stopper plate 79 of the stand 77 is cleared to tilt the stand 77, the second support rail 76 is erected along the unit frame 51, and this state is held by the stopper plate 78, so that the camera 74 and light 75 in the shroud 72 can be returned from the maintenance position outside of the unit frame 51 to the working position inside of the unit frame 51, positioned and fixed.

At this time, since the movement of the support roller 71, in a direction orthogonal to the running direction, is defined by the restricting rail 80, the camera 74 and light 75 in the shroud 72 can be securely positioned and fixed at the specified working position. Thus, the printing quality of the sheet 100 can be inspected precisely by the camera 74 and light 75.

Thus, in this inspection unit 50, the working position is quite natural during maintenance, and the working efficiency can be enhanced. Moreover, since the correcting means, such as the suction table 54, and the inspection means, such as the camera 74 or light 75, can be moved in different directions, maintenance of the correcting means and maintenance of the inspection means can be done at the same time, and the working time can be shortened.

In this embodiment, the support rollers 63 are provided in the moving table 52, and the support rails 64 are provided in the unit frame 51, but the same effects, as in the embodiment, are obtained if, for example, the support rails are provided in the moving table (suction table side) and the support rollers are provided in the unit frame.

In the embodiment, the moving table 52 and shroud 72 are moved in different directions, but maintenance may be also done easily if the moving table 52 and the shroud 72 are moved in the same direction.

In the embodiment, the moving table 52 and shroud 72 are moved manually, but the moving table 52 and shroud 72 may be also moved automatically by using a motor or other actuator. Further, in the embodiment, the second support rail 76 is provided such that it swings pivotally so that the second support rail 76 may be positioned on the extension of the first support rail 70. However, for example, the second support rail 76 may be provided slidably so that the second support rail 76 may be positioned on the extension of the first support rail 70.

The embodiment is applied to the intaglio printing press, but the invention may be also applied in other printing presses such as offset printing press, or installed independently without being incorporated in the printing press. It may be also realized as a printing quality inspection apparatus for inspecting the printing quality of sheet-like object printed by a printing press.

According to the printing quality inspection apparatus of the present invention, since the inspection means and correcting means can be moved between the working position and the maintenance position, at the time of maintenance, only by moving the inspection means and correcting means to a proper maintenance position, maintenance can be done in a natural position, so that the working efficiency may be enhanced.

The invention being thus described, it will be obvious that the same may be varied in many ways. Such variations are not to be regarded as a departure from the sprit and scope of the invention, and all such modifications as would be obvious to one skilled in the art are intended to be included within the scope of the following claims.

What is claimed is:

1. A printing quality inspection apparatus, comprising:

inspection means for inspecting the printing quality of printed sheet-like object; and inspection moving means for moving said inspection means between a working position for inspecting a printing quality of the printed sheet-like object and a maintenance position for maintaining said inspection means, wherein the working position is inside a frame and said maintenance position is outside said frame.

2. A printing quality inspection apparatus, comprising:

inspection means for inspecting the printing quality of printed sheet-like object; and inspection moving means for moving said inspection means between a working position for inspecting a printing quality of the printed sheet-like object and a maintenance position for maintaining said inspection means, said inspection moving means including a rotatably provided support roller, and a guide for guiding between said working position and said maintenance position of said inspection means, wherein said support roller is rotatably disposed at said inspection means, and said guide is a support rail for supporting said support roller, and connecting between said working position and said maintenance position of said inspection means.

3. The printing quality inspection apparatus of claim 2, wherein said support rail includes a first support rail provided inside the frame for supporting said support roller, and a second support rail movably provided to be positioned on an extension of said first support rail.

4. The printing quality inspection apparatus of claim 3, wherein said second support rail is swing pivotally provided so as to move between a guide position positioned on the extension of said first rail and a retreat position for retreating from said guide position.

5. The printing quality inspection apparatus of claim 2, further comprising:

restricting rail for restricting movement of said support roller in a direction orthogonal to the running direction of said support roller.

6. The printing quality inspection apparatus of claim 2, further comprising:

inspection positioning fixing means for positioning and fixing said inspection means such that said inspection means may be positioned at the working position.

7. A printing quality inspection apparatus, comprising:

correcting means for correcting the position of printed sheet-like object;

inspection means disposed inside a frame for inspecting a printing quality of the sheet-like object corrected of position by said correcting means; and moving means for moving at least one of said correcting means and said inspection means to a maintenance position for maintaining, wherein said moving means is corrector moving means for moving said correcting means between a working position for correcting the position of the printed sheet-like object and said maintenance position, the working position being a position in which said correcting means is inside the frame and the maintenance position being a position in which said correcting means is outside the frame.

8. The printing quality inspection apparatus of claim 7, wherein said maintenance position includes a inspection means maintenance position for maintaining said inspection means, and a correcting means maintenance position for maintaining said correcting means, and said moving means includes corrector moving means for moving said correcting means between said correcting position for correcting said position of printed sheet-like object and said correcting means maintenance position, and inspection moving means for moving said inspection means between said inspecting position for inspecting the printing quality of printed sheet-like object and the inspection means maintenance position, and wherein said moving means includes inspection moving means for moving said inspection means between the inspection position for inspecting the printing quality of said printed sheet-like object and the inspection means maintenance position for maintaining said inspection means.

9. The printing quality inspection apparatus of claim 8, wherein a moving direction of said inspection means by said inspection moving means and the moving direction of said correcting means by said corrector moving means are different.

10. A printing quality inspection apparatus, comprising:

correcting means for correcting the position of printed sheet-like object;

inspection means disposed inside a frame for inspecting a printing quality of the sheet-like object corrected of position by said correcting means; and moving means for moving at least one of said correcting means and said inspection means to a maintenance position for maintaining, wherein said moving means is corrector moving means for moving said correcting means between said working position for inspecting the position of printed sheet-like object and said maintenance position, and wherein said corrector moving means includes a roller provided at said correcting means, and a guide provided inside of said frame for guiding the moving of said correcting means.

11. The printing quality inspection apparatus of claim 10, further comprising:

a support roller provided at one of said frame and said correcting means, and rotatable along the moving direction of said correcting means; and a support rail provided a the other of said frame and said correcting means, said support rail being engaged with said support roller for defining a deviation of said correcting means in a direction orthogonal to the moving direction of said correcting means.

12. The printing quality inspection apparatus of claim 11, further comprising:

corrector positioning fixing means for positioning and fixing said correcting means such that said correcting means may be positioned at the working position.

* * * * *